United States Patent [19]

Burke

[11] 3,953,019

[45] Apr. 27, 1976

[54] FILM FOLDING MACHINE

[75] Inventor: Ronald Patrick Burke, Waterford, Ireland

[73] Assignee: Fitzwilton Limited, Dublin, Ireland

[22] Filed: Jan. 9, 1975

[21] Appl. No.: 539,776

Related U.S. Application Data

[63] Continuation-in-part of Ser. No. 306,575, Nov. 15, 1972, abandoned.

[52] U.S. Cl. ..... 270/61 F; 270/79

[51] Int. Cl.[2] ..... B65H 45/00

[58] Field of Search ..... 270/30–31, 270/61 F, 69, 79, 73; 226/118–119; 53/116

[56] References Cited

UNITED STATES PATENTS

| | | | |
|---|---|---|---|
| 1,832,556 | 11/1931 | Jensen | 270/79 |
| 2,016,539 | 10/1935 | Brenn | 270/79 |
| 2,721,371 | 10/1955 | Hodkinson | 270/69 X |
| 2,746,278 | 5/1956 | Artzt | 270/31 X |
| 3,086,768 | 4/1963 | Lach | 270/79 |
| 3,123,269 | 3/1964 | Morley | 270/61 F |
| 3,423,083 | 1/1969 | Sherrill | 270/69 |
| 3,707,063 | 12/1972 | McIntyre | 270/79 |

*Primary Examiner*—Edgar S. Burr
*Assistant Examiner*—A. Heinz
*Attorney, Agent, or Firm*—William R. Liberman

[57] ABSTRACT

The invention is concerned with a new way of packaging film, e.g. plastics film. The film is packaged as a concertina pack. This is done by combining the effects of gas blowers and movable feet. A fold is started by one set of blowers and completed by an opposed set of feet. The next fold is then started by the opposite set of blowers and its corresponding opposed set of feet, and this sequence is repeated until the pack is completed.

4 Claims, 4 Drawing Figures

20
22
1
1
23
5
4
3
25
24
2
2
7
27
26
6
8
28
21
21
38
33
9
34
29
30
9
13
12
12
31
37
32
10
10
11
33
36
11
35
19
18
17
18
16
19
15
14

SEQUENCE OF OPERATIONS FOR 1 REV. OF SHAFT DRIVING RECIPROCATING CARRIAGE

1 REV. OF SHAFT GIVES 1 COMPLETE CYCLE CARRIAGE.

FILM FOLDING MACHINE

CROSS-REFERENCE

This application is a continuation-in-part of my earlier application Ser. No. 306,575 filed Nov. 15, 1972 now abandoned.

BACKGROUND OF THE INVENTION

1. Field of the Invention

This invention relates to a method of and an apparatus for packaging film, in particular plastics film.

The term "film" as used herein includes, in addition to sheet film, gusseted or tubular film and also gusseted or tubular film which has been slit in the longitudinal direction.

2. Description of the prior art

Plastics film is conventionally stored and handled by being wound onto a centre core, e.g. a cardboard tube. The core is discarded once the film has been used. Alternatively, reeled film is conventionally supplied to a so-called conversion section where it is unwound mechanically or manually from a parent core and refolded by a continuous overhand method.

In the first case, the cost of the core has to be borne by the consumer and winding onto a central core increases the storage space needed and freight costs. In the second case, extra labour is required for re-packing and the length tolerance owing to human error is generally an average of about 2%. In use, packs of plastics film produced by folding as described above have the disadvantage that the customer has to unfold the dead weight of the pack and it is in practice impossible to ensure uniformity of the pack.

SUMMARY OF THE INVENTION

The present invention provides a method and an apparatus for packaging film, in particular plastics film which produces the film in the form of a concertina pack. This avoids the above disadvantages, resulting from the prior art methods.

In its broadest aspects, the invention provides a folding device comprising a frame having an inlet for receiving film to be folded and an outlet for folded film, means for feeding the film from the inlet to the outlet via a folding station within the frame adjacent to the outlet, retaining means at the outlet for holding back the film at the folding station until the completion of each set of folding operations on a length of film being folded, at least two sets of blow means arranged to project a pressurized gas onto the film to produce successive folds therein, the sets of blow means being disposed one on each side of the film path so that in use one set acts on one face of the film and the other set acts on the other face, and, corresponding to the two sets of blow means, two arrays of movable folding feet disposed also one on each side of the film path and movable between a masked inoperative position and a position in which, once a fold has been initiated in the film by the action of a set of blow means projecting pressurised gas onto one face of the film the fold is completed by the array of feet on the opposite side of the film relative to the blow means producing the fold pressing down upon the opposite face of the film to that which is receiving the pressurised gas, the array completing the particular fold being immediately thereafter returned to its inoperative position whereupon the other set of blow means acts upon the opposite face of the film and the initiation of the next fold by the gas pressure is completed by pressure upon the other face of the film by the other array of feet being moved from their inoperative position to a position in which they press down upon the other face of the film, the sequence being repeated a number of times governed by the length of film to be folded and the number of folds needed in that length.

In a preferred embodiment of the folding device, the frame is reciprocable on a path at right-angles to the plane of the film to assist in the initiation of each fold by the pressure inserted on the film by the pressurised gas projected against each successive face of the film and the completion of the fold by the immediately succeeding action of the array of feet opposite to the set of blow means which has initiated the fold on the opposite face of the fold. Thus the set of blow means which is to be operative on a face of the film at any one stage is brought near to that face by the reciprocating housing thereby increasing the effectiveness of the jet or jets of pressurised gas blown onto the film and immediately thereafter the array of feet on the opposite side of the film is brought by the opposite movement of the housing nearer to the adjacent face of the film and is therefore assisted in completing the folding operation initiated by the pressurised gas.

The folding device normally forms part of a folding apparatus which comprises feed means for supplying film to be folded to the inlet of the device and conveyor means for removing each pack of folded material at the completion of a full set of folding operations. In addition, the apparatus comprises means for cutting off each length of film fed to the folding stage so as to allow the pack to be ejected from the device and removed by the conveyor means to an unloading stage.

The invention also covers a method of packaging in which a film to be folded into a series of packs formed from successive lengths of film is fed continuously or semi-continuously to a folding station, at which successive folds are produced by the action of pressurized air projected successively onto the two faces of the film and of mechanical pressure means acting on the film faces in association with the pressurised air, each fold being produced by the action of pressurised air on one face of the film acting transversely or substantially transversely to that face to initiate a fold therein, followed by the mechanical pressure means bearing down upon the opposite face of the film to complete the fold and thereafter pressurised gas acting upon the other face of the film to initiate the next successive fold in the film which next fold is completed by the mechanical pressure means acting upon the one face, the next fold being initiated in the one face by pressurised gas and so on in the same sequence until the required number of folds has been produced in the predetermined length of film.

BRIEF DESCRIPTION OF THE DRAWINGS

Reference is now made to the accompanying drawings in which.

CONSTRUCTION

Figure 1:
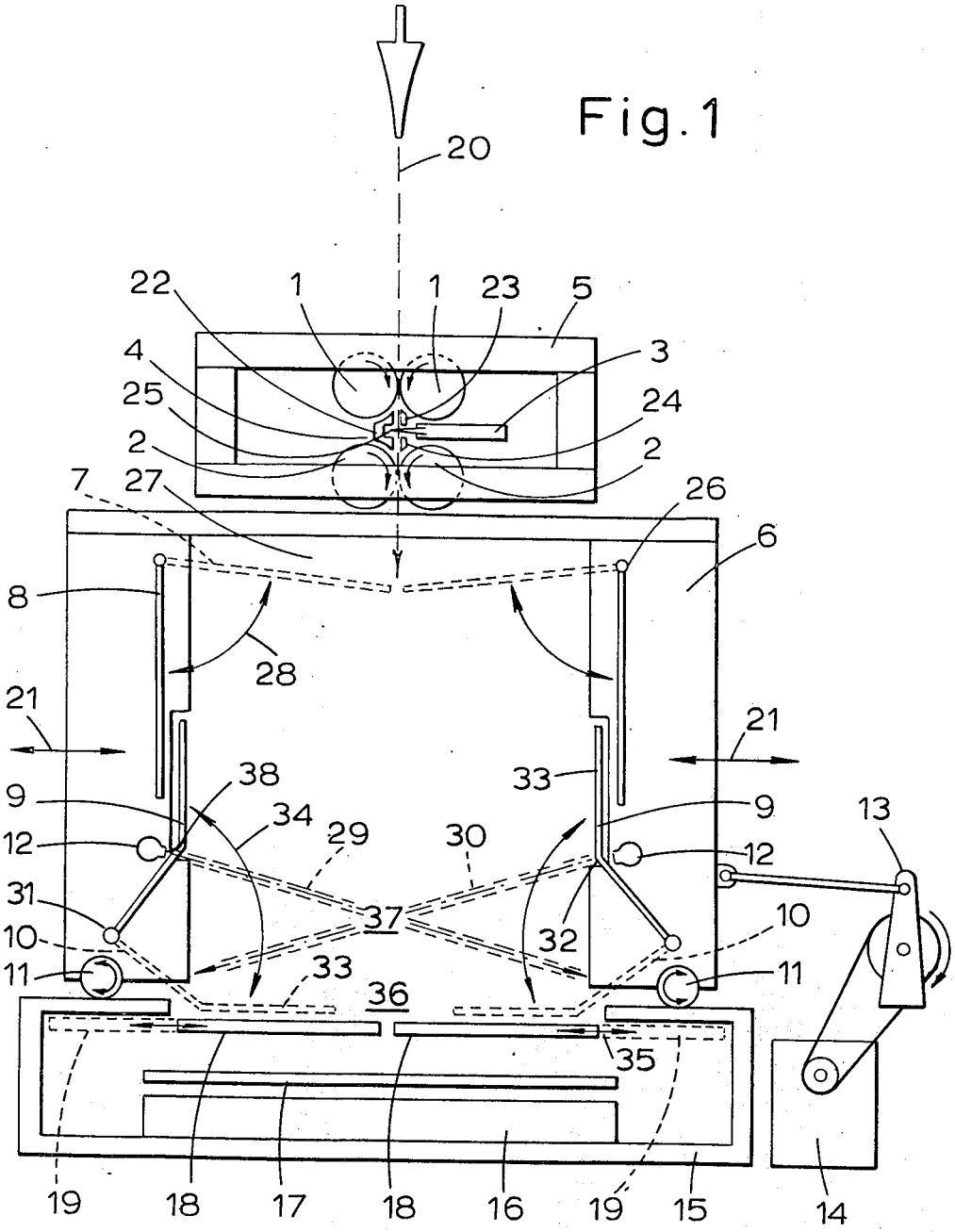
FIG. 1 is a highly diagrammatic vertical section of one embodiment of packaging apparatus according to the invention: the invention for use with plastics film.

The illustrated apparatus comprises a main folding frame 6 with a feed frame 5 positioned above the main frame 6 and a support frame 15 carrying the main and feed frames and incorporating retaining and conveyor means for the pack lengths of plastics film.

The main folding frame 6 bears on the support frame 15 through oscillating rollers 11. A drive 13 with gearing 14 acts on the frame 6 to reciprocate the frame from left to right and back as shown by the arrows 21.

Two pairs of horizontal nip rolls 1 and 2 respectively are supported within the feeding frame 5. The two pairs of rolls are arranged one above the other with their nips in vertical alignment and a guide 4 is positioned between the two pairs of rolls. The guide 4 comprises a pair of opposed plates 22 and 23, the film to be folded passing through the space between the two plates. The plate 23 is slotted at 24 to allow the passage therethrough of a horizontally movable knife 3 which, when in its operative cutting position, extends through the slot 24 into a channel 25 formed within the opposing plate 22.

The main support frame 6 comprises two opposed arrays of retaining fingers 7 which are pivoted to the frame 6 at 26 so as to be capable of movement between an upper near horizontal position in which they hold back film to be folded and a lower vertical position in which they allow film to pass through the inlet 27 of the frame 6 into the inside of the frame unhindered by the fingers 7. The upper operative position is shown by dotted lines and the lower vertical position is shown by full lines at 8. Arrows 28 show the movement of the fingers 7.

A pair of air pipes 12 are supported horizontally opposite one another at the two sides of the frame 6. The pipes are formed each with a set of inwardly directed outlets 38 which are shaped or positioned so that pressurised air issuing from the pipes 12 is projected obliquely downwardly as shown by the dotted lines 29 and 30, respectively. The feed to the pipes 12 and the source of compressed air are not shown.

Two opposed sets of fingers 9 are pivoted to the frame 6 at 31 so as to oppose one another on each side of the frame. The fingers 9 are crooked as shown at 32 so that in their upper inoperative position (full line) the outer end part 33 of each finger is vertical. The fingers 9 are movable downwardly as shown by the arrows 34 so that the outer parts 33 are brought to horizontal positions as shown by the dotted outlines 10 of the fingers 9.

The support frame 15 carries horizontal jaws 18 which are reciprocable as shown by the arrows 35 between inner end positions shown in full lines in which the jaws 18 support a length of film being folded into a pack and outer end positions shown in dotted lines at 19 which disclose the outlet 36 of the frame 6 and allow the completed pack to leave the frame 6. The frame 15 also comprises a mechanical conveyor 17 and an air conveyor table 16.

The apparatus just described operates as follows:

A plastics film which is to be folded is fed vertically downwards into the nip between the upper feed rolls 1 and thereafter via the lower feed rolls 2 into the inlet 27 of the frame 6. The operation is considered at an instant when the retaining fingers 7 have been swung downwardly out of the way of the film to allow progress into the frame 6 so as to reach the folding station 37, near the outlet 36 of the frame 6. At the station 37, a blast from the outlets 38 of the right pipe 12 for example impinges transversely and slightly downwardly on the right face of the film 20. At that moment, the whole of the carriage 6 is at or near its left position at which the right outlets 38 are adjacent to the right face of the film 20. The blast 30 produces a depression in the film which is being continuously fed downwardly during the movement of the frame 6 and the blowing operation just mentioned. The depression formed in the film is extended to initiate a fold concave towards the right side.

Since at the time of subjecting the film to the blast 30 the frame 6 was at or near its extreme left position, immediately after the initiation of this fold the frame 6 is being returned to its extreme right position and at the same time the left fingers 9 are actuated by drive means which are not shown so that the ends 33 of the fingers 9 are brought to bear upon the upper of the two portions of the film which define the fold initiated by the air blast 30. The fingers 9 press upon the upper portion of the convex face of the fold whilst film is still being fed downwards under the impulse of the drive rolls 1 and 2. The fold in the film is therefore completed by the left hand fingers reaching their positions 10.

Immediately after the completion of this first fold which is retained upon the doors 18 in their inward position, the left fingers 9 are returned to their upper inoperative positions. It should be noted that the blast 30 is interrupted before the completion of the folding operation. The opposite blast 29 is then directed by the left pipe 12 onto the opposed left face of the film 20 to initiate the next successive fold convex towards the right and concave in the direction of the blast 29. The initiation of this fold is followed by the downward movement of the right fingers 9 which complete this second fold. The operation is repeated until the required number of folds have been produced in the predetermined length of film.

When the desired film has been fed beyond the upper rolls 1, the knife 3 is actuated to sever the film and to allow the tail of the forward severed length to pass through the bottom rolls 2 and enter the frame 6 where the folding operation is completed. Whilst the folding of this length is being completed, the next length is being fed through the nips of the two rolls 1 and 2 and is therefore retained by the fingers 7 which are in their upper dotted line position. The doors 18 supporting the completed pack of film are retracted to their outer positions 19 to allow the pack to fall onto the mechanical conveyor 17 from which it is conveyed to the air conveyor table 16 allowing manual or mechanical handling of the completed pack. Immediately the completed pack has left the folding station 37 the retaining fingers 7 are dropped downwardly to their lower vertical inoperative positions 8 a lowing the next length of film to be folded in the same manner as described above.

OPERATION

Figure 2:
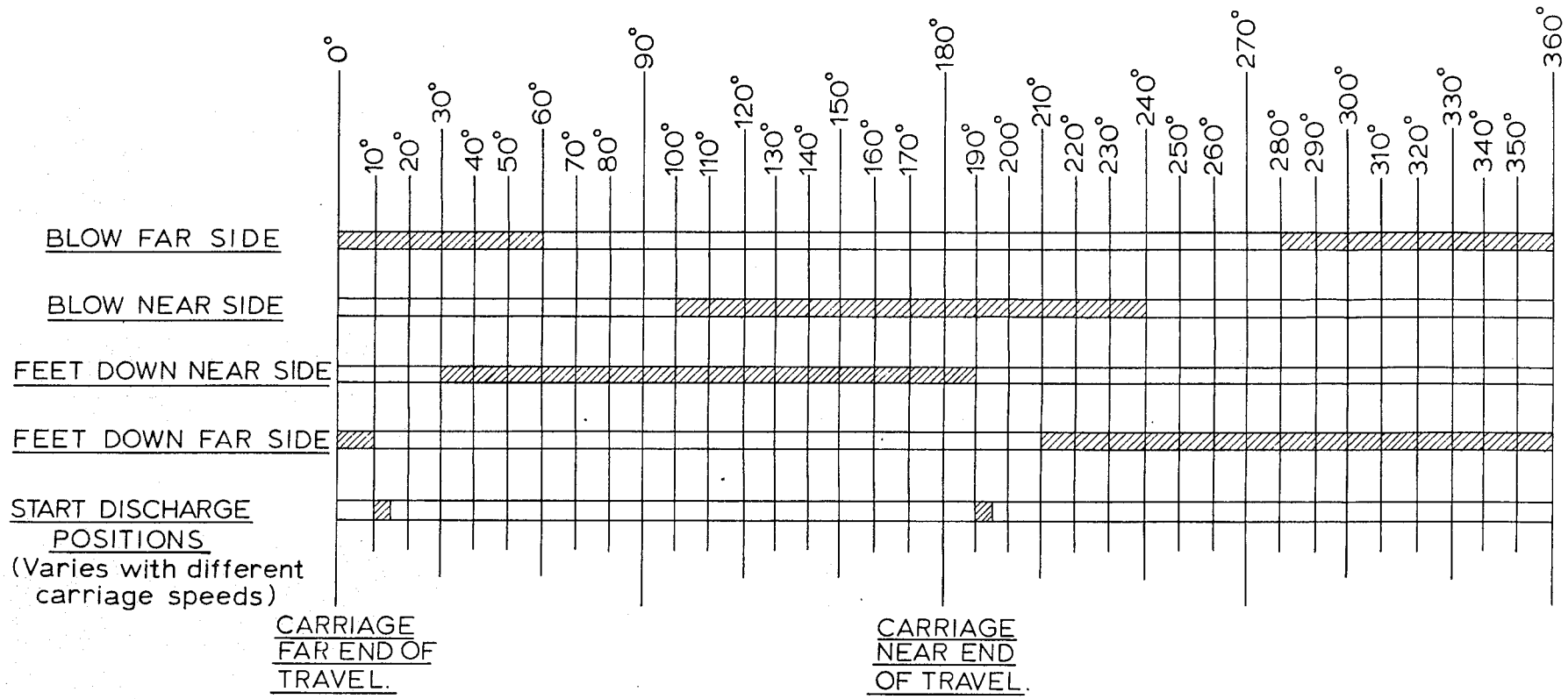
FIGS. 2 and 3 are cycle diagrams illustrating the time sequence of the operation of the apparatus.
Figure 4:
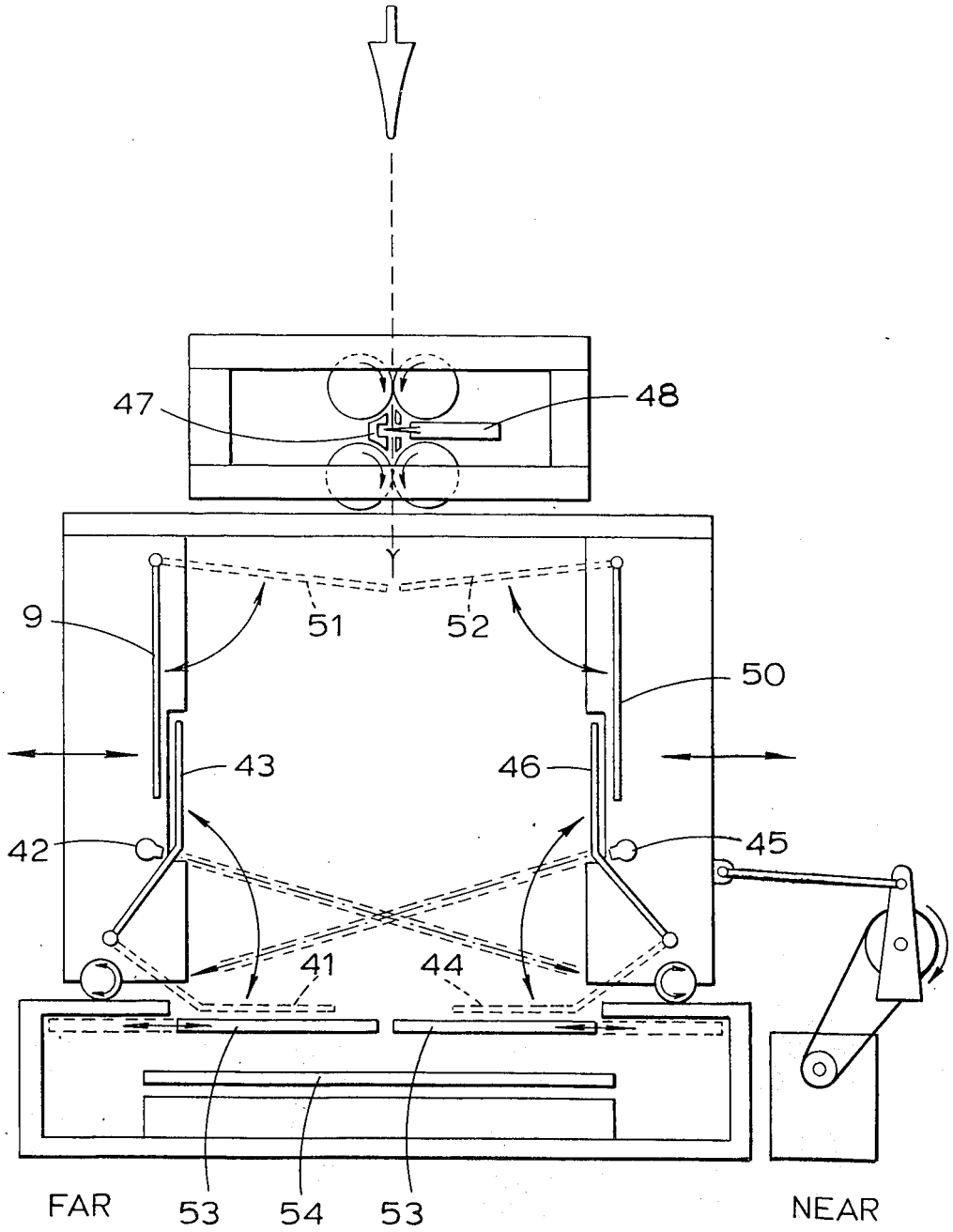
FIG. 4 is a repitition of FIG. 1 but associated with FIGS. 2 and 3.

The following description with reference to the accompanying FIGS. 1 and 2 which are in the form of bar charts. FIG. 4 refers to the sequences of operations involved in the folding of continuously advancing layer(s) of film into folded packs automatically cut to a pre-set length and deposited onto a conveyor.

The operation has two controlling modes:

A. The sequence which provides continuous folding of film into a reciprocating carriage; and B. The discharge sequence which cuts the film to a pre-set pack length, compacts the pack in the reciprocating carriage and deposits the pack onto a conveyor belt. The discharge sequence (B) overrides the folding sequence (A).

DESCRIPTION OF FOLDING SEQUENCE A

This is best described with reference to FIGS. 2 and 4, and moving through the sequence from left to right. The reciprocating carriage moves through one complete cycle over the 360° cycle.

The FAR and NEAR positions are shown on FIG. 4.

i. The farside feet are in the compacting position (41)
ii. Air is blown from the far side sparge (42).
iii. The far side feet (43) move into the remote position.
iv. The near side feet move into the compacting position (44).
v. Far side blowing stops (42).
vi. Near side blowing commences (45).
vii. Near side feet withdraw to the remote position (46).
viii. Far side feet move to compacting position (41).
ix. Near side air stops (45).
x. Far side air commences (42).
iii., (iv) and so on are repeated.

The discharge cycle can only operate when the carriage is in position 10° or 210° as indicated on FIG. 2.

DESCRIPTION OF DISCHARGE SEQUENCE B

Figure 3:
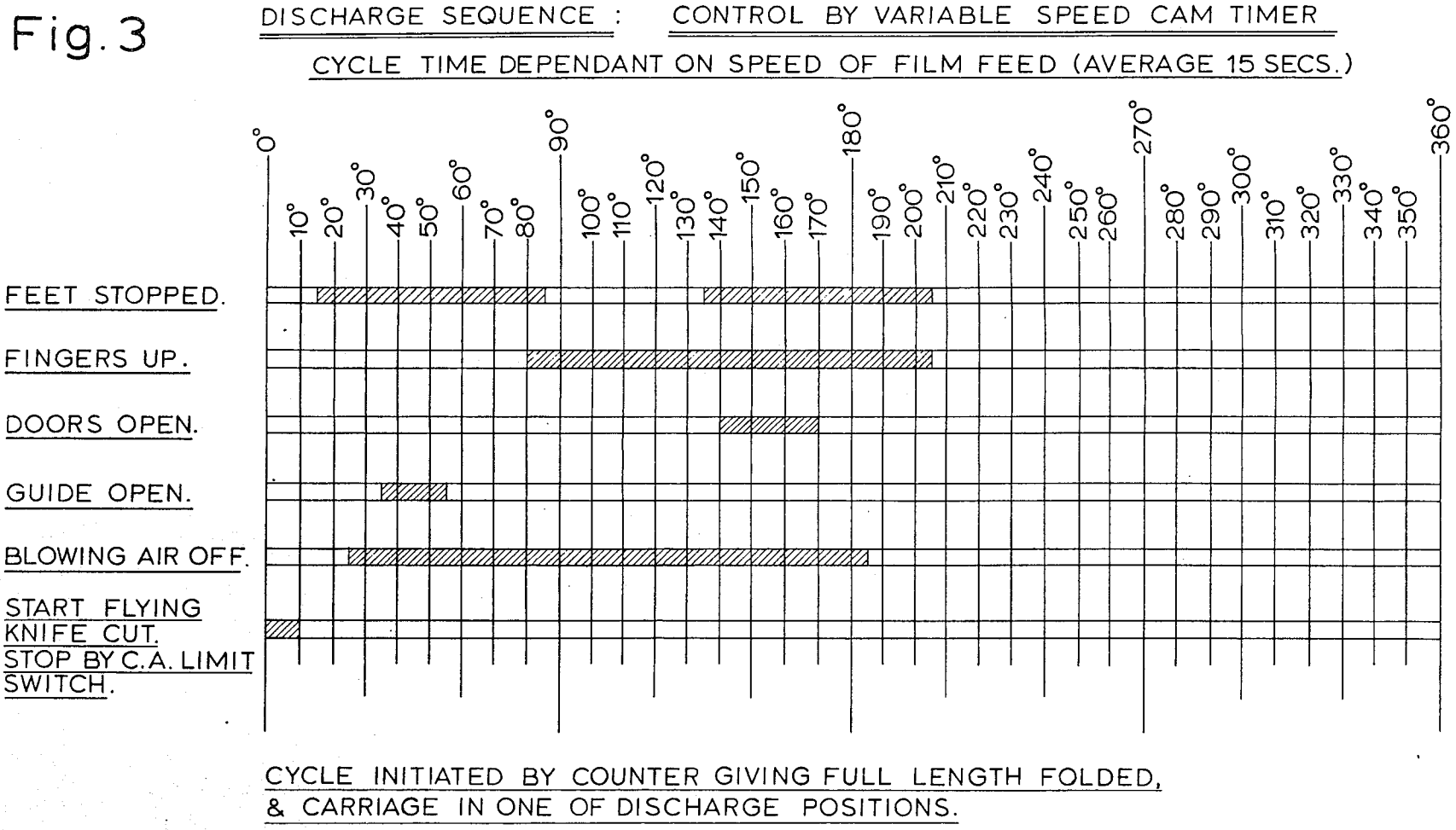

Reference should be made to FIGS. 3 and 4.

i. A flying knife cuts the advancing layer(s) of film (47).
ii. The feet move to the remote position (43) and (46).
iii. All blowing stops (42) and (45).
iv. Guide opens (48).
v. Fingers move upwards to hold oncoming layer(s) of film from (49) and (50) to (51) and (52).
vi. Both sets of feet independently go through a compacting motion (to compact the completed pack in the reciprocation chamber) and then withdraw to the remote position.
vii. The doors of the carriage open (53) and deposit the completed pack to the conveyor beneath (54).
viii. The carriage doors close.
ix. The fingers withdraw to the remote position.
End of cycle.

The apparatus described above is normally directly associated with an extrusion device for the production of film and the feed to the first pair of nip rolls may be made directly from the extrusion die. Alternatively, the apparatus may be associated with a storage reel of film in which case film is fed directly from the storage reel to the first pair of nip rolls 1.

Preferably, the ejected stack of concertina folded film is carried away from the folding machine by means of the continuous moving conveyor 17. When the film has been removed from the area of the folding machine it preferably passes over the stationary air bed 16 which allows the pack of film which may weigh up to 100 kilograms to be moved easily to its final packing station. Before packing, it may be desirable to fold the concertina stack of film further in order to fit a suitable container or outer covering such as for example a plastics bag or sack.

We have found that, using the apparatus of the invention, very wide film (11′ 6″ with gusseted material 45′ slit film) can be folded at speeds of 60 feet per minute to produce a pack of any predetermined length of film. The pack is much more easily opened out by the user than the conventional core reels and there is further the advantage of a gain in space by the omission of the conventional core.

One advantage of the folding device of the invention is that the production of the concertina stack of folded material results from a combination of the reciprocating action of the folding frame itself and the alternating blasts of compressed air from the pipes 12, the folds being consolidated by the alternating movable feet 9 which work in synchronism with the frame 6. The apparatus of the invention therefore has the advantage over conventional apparatus that it does not require any rods or mechanical arms to create the folds in the film which can easily, when the apparatus becomes maladjusted, jam in the film or cause wrinkling or distortion thereof. The feet 9 are able to operate without being impeded by any arms or rods and there is therefore no danger of being entangled with such additional parts.

I claim:

1. A folding device comprising a frame having an inlet for receiving film to be folded and an outlet for folded film, means for feeding the film from the inlet to the outlet along a path passing through a folding station within the frame adjacent to the outlet, opposed retaining fingers pivoted to the frame within and closely adjacent the inlet thereof, said fingers being movable between an upper near horizontal position in alignment with said path wherein movement of the film to be folded is restrained and a lower vertical position in which the fingers are spaced sufficiently to allow film to pass through the inlet freely into the frame, retaining means adjacent the outlet for holding back the film at the folding station until the completion of each set of folding operations on a length of film being folded, at least two opposed sets of blow means to project a pressurized gas onto the film at successive levels of the film to produce successive folds therein, the sets of blow means being disposed one on each side of the film path so that in use one set acts on one face of the film and the other set acts on the other face, and, corresponding to the two sets of blow means, two arrays of movable folding feet disposed also one on each side of the film path and movable between an inoperative position and a position in which, once a fold has been initiated in the film by the action of a set of blow means projecting pressurized gas onto one face of the film, the fold is completed by the array of feet on the opposite side of the film relative to the blow means producing the fold pressing down upon the opposite face of the film to that which is receiving the pressurized gas, the array completing the particular fold being immediately thereafter returned to its inoperative position, whereupon the other set of blow means acts upon the opposite face of the film and the initiation of the next fold by the gas pressure is completed by pressure upon the other face of the film by the other array of feet being moved from their inoperative position to a position in which they press down upon the other face of the film, the sequence being repeated a number of times governed by the length of film to be folded and the number of folds needed in that length.

2. A folding device as claimed in claim 1 in which the frame is reciprocable on a path at right-angles to the plane of the film to assist in the initiation of each fold by the pressure inserted on the film by the pressurised gas projected against each successive face of the film and the completion of the fold by the immediately succeeding action of the array of feet opposite to the set of blow means which has initiated the fold on the opposite face of the fold, the set of blow means which is to be operative on a face of the film at any one stage being brought near to that face by the reciprocating housing thereby increasing the effectiveness of the pressurised gas blown onto the film and immediately thereafter the array of feet on the opposite side of the film being brought by the opposite movement of the housing nearer to the adjacent face of the film thereby assisting in completing the folding operation initiated by the pressurised gas.

3. A folding device as claimed in claim 2 and further comprising feed means spaced from the frame for supplying film to be folded to the inlet of the device and conveyor means spaced from the frame for removing the folded material at the completion of the folding operations.

4. A method of packaging a film to be folded into a series of packs formed from successive lengths of film which comprises the steps of continuously feeding a length of film downwardly from a source thereof to a folding station, intermittently retaining the continuously fed film against movement and then lowering same to a position whereat the film is free to move thereby forming successive folds at such folding station by projecting pressurized air successively onto the two faces of the film at different vertical levels to define a fold and thereafter flattening the fold, each fold being produced by the action of the projected pressurized air on one face of the film acting transversely to that face to initiate a fold therein followed by the application of mechanical pressure means bearing down upon the opposite face of the film to complete the fold, and thereafter projecting pressurized gas upon the other face of the film to initiate the next successive fold in the film which next fold is completed by the application of mechanical pressure acting upon the one face, the succeeding fold being initiated in the one face by the pressurized gas and so on in the same sequence until the required number of folds has been produced in the predetermined length of film, the method including the step of moving the pressure applying means and the sources of the pressurized air reciprocably along a path at right angles to the plane of the film to initiate each fold by bringing the projected air into proximity to the face of the film being treated.

* * * * *